US007973660B2

(12) United States Patent
Hall

(10) Patent No.: US 7,973,660 B2
(45) Date of Patent: Jul. 5, 2011

(54) ELECTRONIC ARTICLE SURVEILLANCE DEACTIVATOR WITH MULTIPLE LABEL DETECTION AND METHOD THEREOF

(75) Inventor: Stewart E. Hall, Wellington, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 272 days.

(21) Appl. No.: 12/178,194

(22) Filed: Jul. 23, 2008

(65) Prior Publication Data

US 2010/0019904 A1 Jan. 28, 2010

(51) Int. Cl.
*G08B 13/14* (2006.01)

(52) U.S. Cl. ..... 340/568.1; 340/572.1; 340/10.42; 340/540; 235/383

(58) Field of Classification Search ..... 340/572.1, 340/572.3, 573.4, 521, 541, 568.1, 10.364, 340/10.42; 235/383, 481, 385, 375, 382.5; 455/83

See application file for complete search history.

(56) References Cited

U.S. PATENT DOCUMENTS

| | | | | |
|---|---|---|---|---|
| 5,563,583 | A * | 10/1996 | Brady et al. | 340/572.2 |
| 6,530,520 | B1 | 3/2003 | Snyder et al. | |
| 7,492,316 | B1 * | 2/2009 | Ameti et al. | 342/465 |
| 7,619,528 | B2 * | 11/2009 | Kobres | 340/572.3 |
| 2002/0011933 | A1 * | 1/2002 | Andersen et al. | 340/572.1 |
| 2003/0076239 | A1 * | 4/2003 | Wenzel et al. | 340/825.49 |
| 2004/0113791 | A1 | 6/2004 | Salim et al. | |
| 2005/0040950 | A1 * | 2/2005 | Clucas | 340/572.1 |
| 2005/0099269 | A1 * | 5/2005 | Diorio et al. | 340/10.51 |
| 2005/0200483 | A1 * | 9/2005 | Eckstein et al. | 340/572.2 |
| 2006/0175402 | A1 * | 8/2006 | Maitin | 235/383 |
| 2007/0008101 | A1 * | 1/2007 | Fallin et al. | 340/506 |
| 2007/0018792 | A1 * | 1/2007 | Taki et al. | 340/10.1 |
| 2007/0103301 | A1 * | 5/2007 | Bowman et al. | 340/572.1 |
| 2008/0252422 | A1 * | 10/2008 | Dowla et al. | 340/10.1 |
| 2009/0040084 | A1 * | 2/2009 | Frederick et al. | 341/122 |

FOREIGN PATENT DOCUMENTS

EP 0999531 A1 5/2000

OTHER PUBLICATIONS

International Search Report and Written Opinion dated Nov. 11, 2009 for International Application No. PCT/US2009/004140, International Filing Date Jul. 17, 2009 (10-pages).

* cited by examiner

*Primary Examiner* — George A Bugg
*Assistant Examiner* — Hoi C Lau
(74) *Attorney, Agent, or Firm* — Alan M. Weisberg; Christopher & Weisberg, P.A.

(57) ABSTRACT

A method and system for preventing simultaneous deactivation of multiple electronic article surveillance ("EAS") tags. An RF pulse is transmitted within an EAS interrogation zone to induce a response from at least one EAS tag placed within the interrogation zone. The response of the at least one EAS tag is received. A presence of more than one EAS tag is determined by evaluating a frequency response curve corresponding to the response.

16 Claims, 6 Drawing Sheets

10

ELECTRONIC ARTICLE SURVEILLANCE DEACTIVATOR WITH MULTIPLE LABEL DETECTION AND METHOD THEREOF

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to a method, system and electronic article surveillance ("EAS") tag deactivator for deactivating "EAS" tags/labels, and more specifically to a method and system for detecting when multiple EAS tags/labels are being deactivated simultaneously.

BACKGROUND OF THE INVENTION

Shoplifting and other theft prevention has always been an important aspect for successful operation of any wholesale or retail sales facilities. Recent advances in automatic article identification technology provide these facilities with an improved means for detecting when an article is being shoplifted. One such method, Electronic Article Surveillance ("EAS"), typically includes an EAS detector and EAS devices commonly called labels, tags or transponders. The EAS detector transmits a radio-frequency ("RF") carrier signal to any EAS device within a certain range of the detector. An active EAS device responds to the carrier signal by generating a response signal of a predetermined frequency, which triggers an alarm when received at the detector. For example, an active magneto-acoustic EAS tag resonates at a predetermined frequency when stimulated by an interrogation signal. When a customer purchases an item that is protected by an active EAS tag, a cashier typically deactivates the tag using deactivator that produces a magnetic deactivation field that alters the resonant frequency characteristic of the tag so that it no longer resonates at the predetermined frequency. The item may then be removed from the store without triggering an alarm.

A common method for shoplifting involves the collusion between a cashier and a customer known to the cashier to deactivate tags on items that have not actually been purchased. This method is referred to in the industry as "sweet-hearting." Sweet-hearting takes place when a cashier scans or "rings up" one item and uses a deactivator to deactivate the EAS tag or label on more than one item. Generally, the cashier will physically "piggy-back" one item on top of another item so that a bar code scanner reading the universal product code ("UPC") label will only detect the lower item, i.e., the item whose UPC label faces the bar code scanner. The cashier then passes the items over the deactivator, which deactivates both items simultaneously by transmitting an RF signal that both EAS tags receive. Often the item that is actually scanned and paid for is a low-cost item and the item that is simultaneously deactivated and not paid for is a high cost item. This shoplifting technique is difficult to visually detect because the cashier appears to be properly scanning and deactivating products. It is very difficult to determine that two items have been deactivated while only one has been purchased.

There are currently methods that prevent deactivation of EAS labels without scanning. These usually involve disabling the EAS deactivator until an item has been scanned. However, this method does not prevent sweet-hearting, it only prevents the occurrence of more than one deactivation process per scan.

Additionally, video monitoring may also used to try to detect sweet-hearting. The disadvantage of video methods is that they require surveillance personnel to manually review video tape to find evidence. Also, cashiers or service personnel that actually commit these sweet-hearting acts may be quite adept at concealing their actions from video surveillance, thus, even the most prudent observer may not detect the action.

Therefore, what is needed is a method to automatically detect the simultaneous deactivation of multiple EAS labels so that suspicious transactions may be identified.

SUMMARY OF THE INVENTION

The present invention advantageously provides a method, EAS tag deactivator and security system for preventing simultaneously deactivation of multiple electronic article surveillance ("EAS") tags. Generally, the present invention provides a method for examining the frequency response of an EAS tag placed in an interrogation zone of the deactivator prior to deactivation. If the frequency response includes more than one peak, a video collection event is triggered to capture video footage of the deactivation. Alternatively, further EAS tag deactivation may be inhibited.

One aspect of the present invention provides a method for preventing simultaneous deactivation of multiple EAS tags. An RF pulse is transmitted within an EAS interrogation zone to induce a response from at least one EAS tag placed within the interrogation zone. The response of the at least one EAS tag is received. A presence of more than one EAS tag is determined by evaluating a frequency response curve corresponding to the response.

In accordance with another aspect, the present invention provides an electronic article surveillance ("EAS") tag deactivator for deactivating at least one EAS tag. The EAS tag deactivator has a transceiver and a controller communicatively coupled to the transceiver. The transceiver is operable to transmit an RF pulse within an EAS interrogation zone to induce a response from the at least one EAS tag placed within the interrogation zone and to receive the response of the at least one EAS tag. The controller is operable to determine a presence of more than one EAS tag by evaluating a frequency response curve corresponding to the response.

In accordance with yet another aspect, the present invention provides a security system for preventing theft of merchandise. The security system includes a plurality of EAS tags and an EAS tag deactivator. The EAS tag deactivator is operable to transmit an RF pulse within an EAS interrogation zone to induce a response from at least one EAS tag placed within the interrogation zone. The EAS tag detector is further operable to receive the response of the at least one EAS tag, determine that the response contains more than one peak in a frequency response curve corresponding to the response, and evaluate the frequency response curve of the response to determine a presence of more than one EAS tag.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
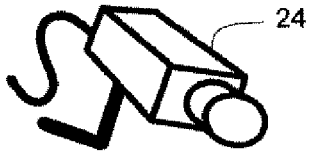
FIG. 1 is an illustration of an electronic article surveillance ("EAS") tag deactivation system constructed in accordance with the principles of the present invention.
Figure 1:
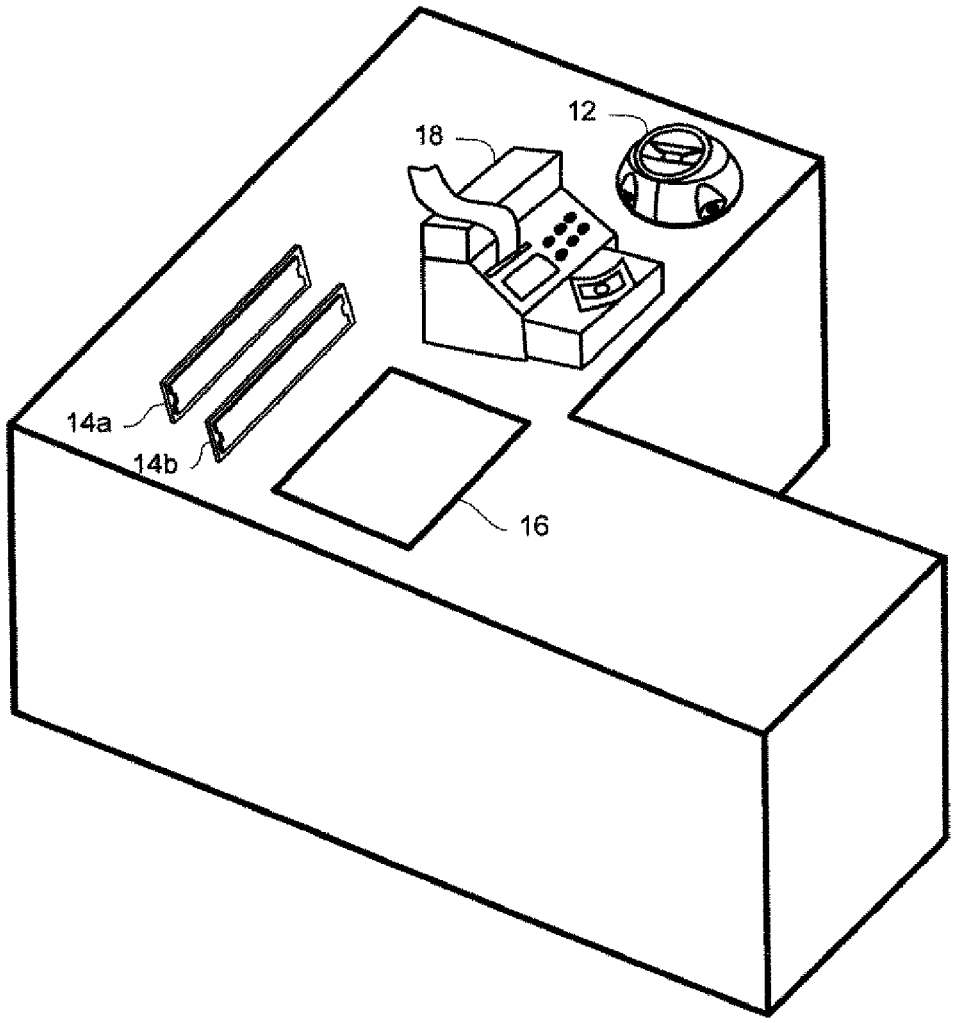

Before describing in detail exemplary embodiments that are in accordance with the present invention, it is noted that the embodiments reside primarily in combinations of apparatus components and processing steps related to implementing a system and method for automatically detecting the simultaneous deactivation of multiple EAS labels so that suspicious transactions may be identified. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements. The terms "EAS tag" and "EAS label" may be used interchangeably in reference to an electronic article surveillance device affixable to an item of merchandise and detectable by an EAS detector and/or EAS reader. Additionally, as used herein, the term "Zigbee" relates to a suite of high-level wireless communication protocols as defined by the Institute of Electrical and Electronics Engineers ("IEEE") standard 802.15.4. Further, "Wi-Fi" refers to the communications standard defined by IEEE 802.11. The term "WiMAX" means the communication protocols defined under IEEE 802.16. "BLUETOOTH" refers to the industrial specification for wireless personal area network ("PAN") communication developed by the Bluetooth Special Interest Group.

One embodiment of the present invention advantageously provides an EAS tag/label deactivator that has the ability to detect multiple labels within a deactivation zone by identifying more than one label response frequency. The deactivation zone may include or overlap an interrogation zone wherein the deactivator determines that only one EAS tag is present prior to magnetizing the deactivation zone. The deactivator performs a frequency discrimination method using fast-Fourier transforms ("FFT") or alternate frequency measurement algorithms to measure the frequency of signals emanating from EAS tags/labels within the interrogation zone. When more than one EAS label is detected, the deactivator may be inhibited from further operation to prevent deactivation of more than one label at a time.

Another embodiment of the deactivator may be equipped with a communication capability to register multiple detection events in a database or to trigger recording by a video camera to capture the event for potential action by loss prevention authorities.

In an alternate embodiment of the invention, a DC bias field may be introduced into the detection field of the deactivator. Since multiple labels are presented to the deactivator in different locations and orientations, the DC bias field causes different levels of frequency shift in each of the labels present in the deactivator's detection field allowing the system to better discriminate the presence of multiple labels.

Figure 2:
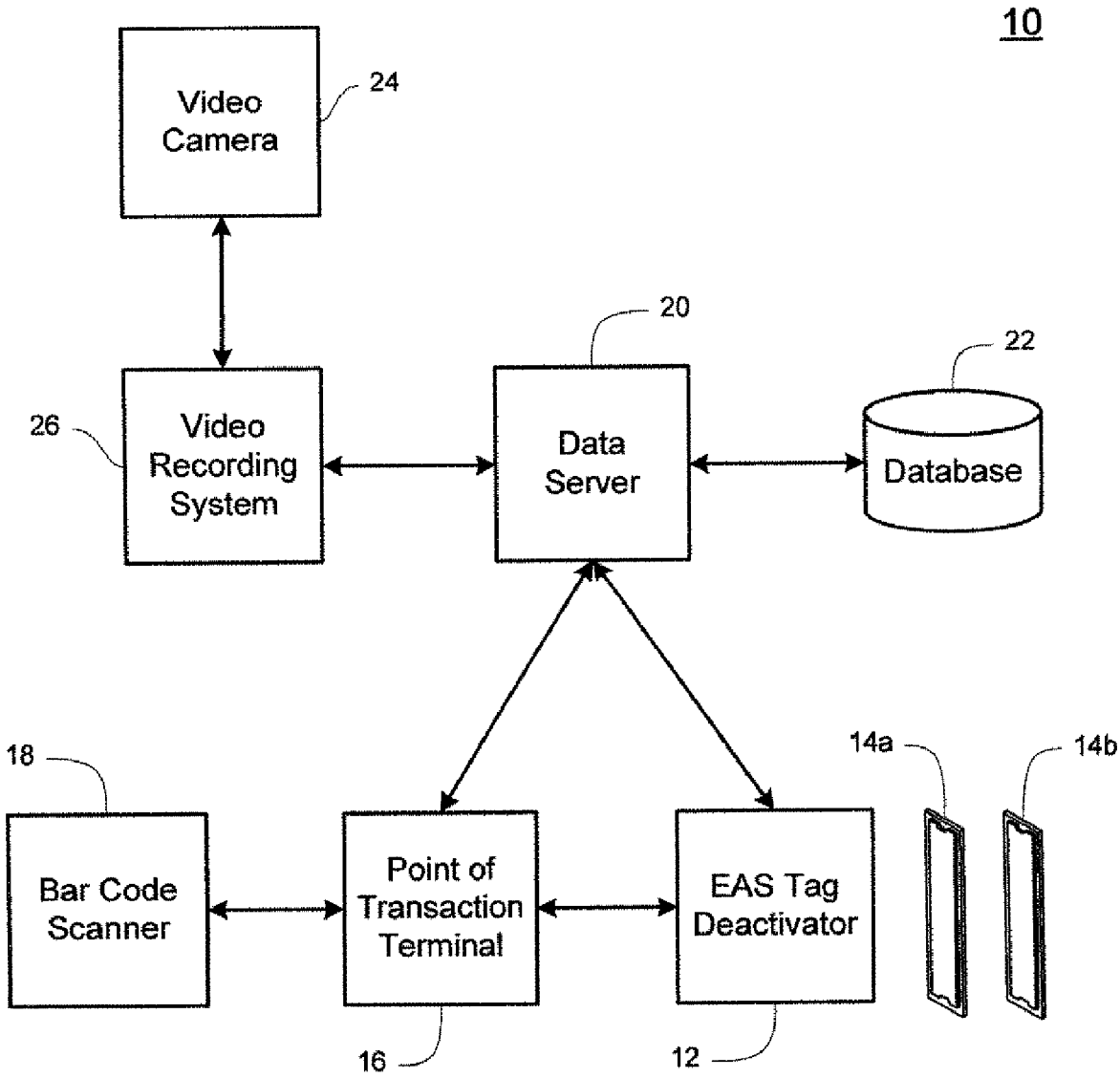
FIG. 2 is a block diagram of the electronic article surveillance ("EAS") tag deactivation system of FIG. 1, constructed in accordance with the principles of the present invention.

Referring now to the drawing figures in which like reference designators refer to like elements, there is shown in FIGS. 1 and 2, an exemplary electronic article surveillance ("EAS") tag deactivation system 10 for automatically detecting the simultaneous deactivation of multiple EAS labels, constructed in accordance with the principles of the present invention. System 10 may include an EAS deactivator 12 for deactivating and/or removing EAS tags 14*a*, 14*b* (collectively referenced as EAS tag 14), a bar code scanner 16, and a point of transaction ("POS") terminal 18, e.g., a cash register. The bar code scanner 16 scans Universal Product Code ("UPC") labels affixed to or printed on items of merchandise to determine the identity of the item and report the items to the point of transaction terminal 18. UPC bar code scanning is known in the art and is beyond the scope of the present invention. The barcode scanner 16 is currently shown as a separate device on the POS terminal 18; however, the barcode scanner 16 may also be mounted in the counter adjacent to the deactivator 12. Additionally, many new deactivator products include the deactivator coil mounted inside the cover of the scanner (integrated scanner/deactivator). Both of these mounting options allow the cashier to scan and deactivate in a single motion, thereby improving the speed at which the transaction may be completed. The point of transaction terminal 18 records information concerning the sale of the item or other transaction. The point of transaction terminal 18 may be in communication with a data server 20 containing a database 22 of all transactions processed by the system 10.

Additionally, the system 10 may include a video camera 24 for capturing surveillance video of actions occurring in the vicinity of the point of transaction terminal 18. The video camera 24 may be communicatively coupled to a video recording system 26 for storing captured video images for later retrieval. The system 10 may also trigger an audible and/or visual alarm (not shown).

Figure 3:
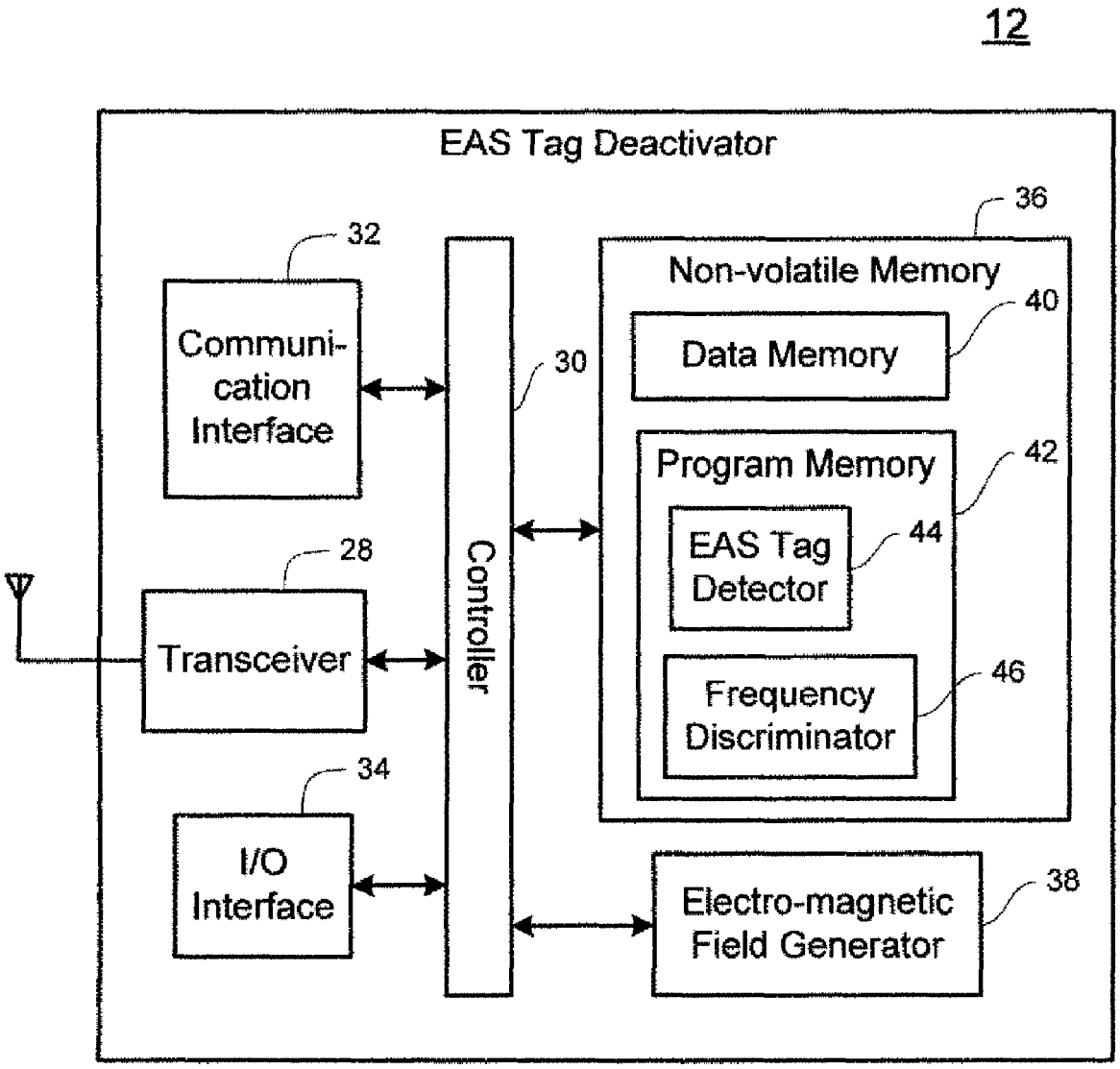
FIG. 3 is a block diagram of an EAS tag deactivator constructed in accordance with the principles of the present invention.

Referring now to FIG. 3, an exemplary EAS deactivator 12 includes a transceiver 28 communicatively coupled to a controller 30. The transceiver 28 transmits RF signals to any EAS tags 14 within an applicable interrogation zone and receives a response signal at a primary frequency from the tags 14. The controller 30 controls the processing of information and the operation of the EAS deactivator 12 in a well-known manner. The controller 30 is also coupled to a communication interface 32 which controls the transfer of information between the deactivator 12 and the point of transaction terminal 18, the data server 20 and/or the video recording system 26. The communication interface 32 may be wired, wireless, or any combination thereof. The communication interface 32 transfers data between the deactivator 12 and the point of transaction terminal 18, the data server 20 and/or the video system 26 using known communication protocols such as, for example, Ethernet, Wi-Fi, WiMAX, Zigbee, Bluetooth, etc. Additionally, the communication interface 32 may transfer information between the deactivator 12 and the point of transaction terminal 18 using a proprietary communication protocol.

The controller 30 is also coupled to an input/output interface 34 and a non-volatile memory 36. The input/output interface 34 controls the reception and presentation of information to and from a user through various well-known peripheral devices such as a display screen, a keyboard, a mouse, a printer, a web browser, etc. The controller 30 may also be coupled to a DC-biased electromagnetic field generator 38 which is used to generate a magnetic field to shift the frequency response of any EAS tag 14 located within the deactivation zone.

The non-volatile memory 36 includes a data memory 40 and a program memory 42. Examples of non-volatile memory include, but are not limited to, a hard drive, a memory stick, an Electrically Erasable Programmable Read-Only Memory ("EEPROM"), a flash memory, etc. Additionally, instead of or in addition to non-volatile memory 36, the data memory 40 may be included as some form of volatile memory, e.g., RAM. The program memory 42 contains an EAS tag detector 44 for detecting the presence of one or more EAS tags 14 within the deactivation zone and a frequency discriminator 46 for measuring the frequencies of detected signals. The operation of the EAS tag detector 44 and the frequency discriminator 46 are discussed in more detail below.

Figure 4:
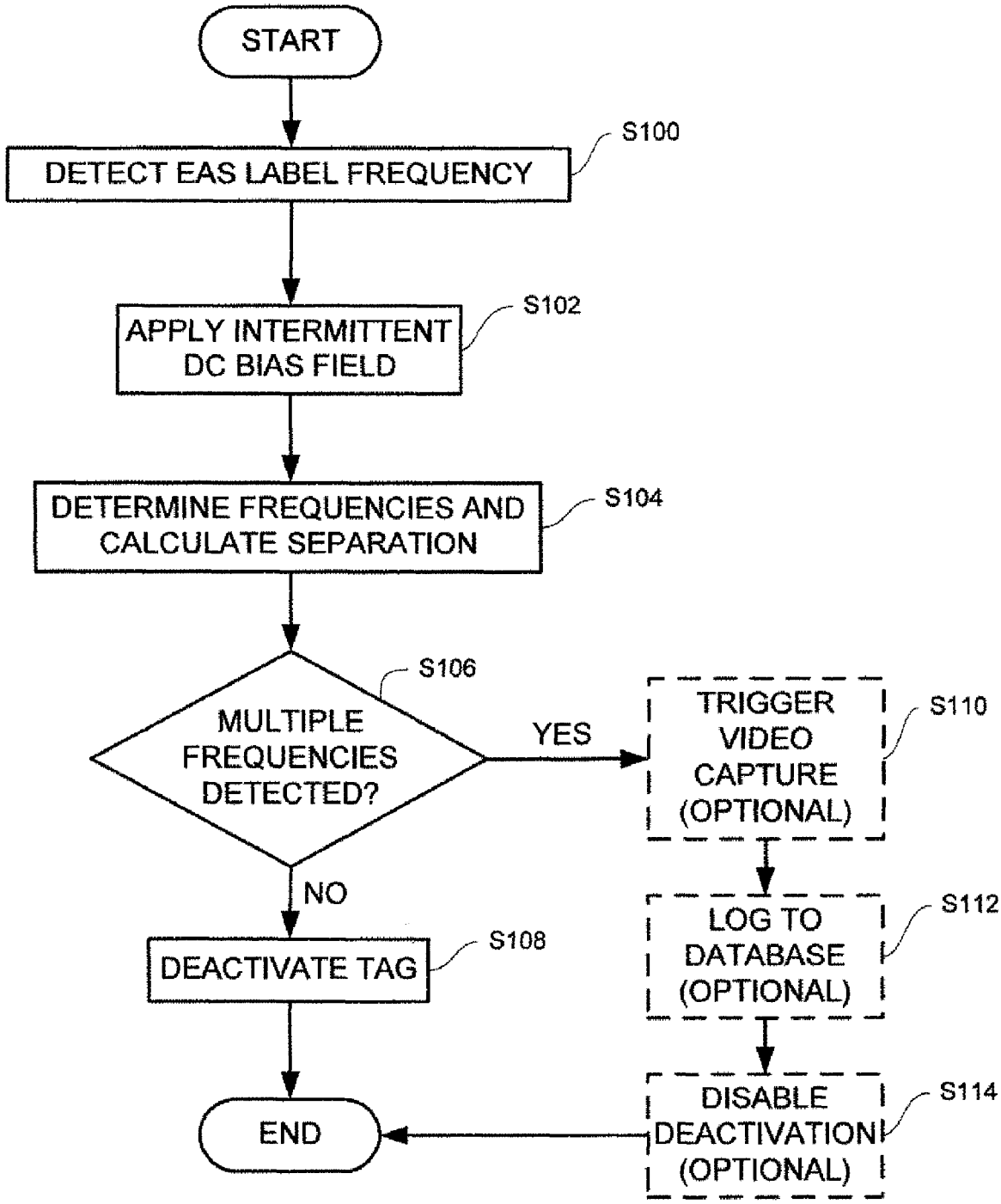
FIG. 4 is a flowchart of an exemplary multiple tag detection process according to the principles of the present invention.

Referring now to FIG. 4, an exemplary operational flowchart is provided that describes steps performed by an EAS tag deactivator 12 for simultaneously detecting multiple EAS tags 14. Of note, although the present invention is described with respect to the EAS tag deactivator 12 detecting and deactivating the EAS tags 14, the present invention is not limited to such. It is contemplated that a device (not shown) that is separate from the tag deactivator 12 can be used to detect the presence of the EAS tags 14 and communicate with the EAS tag deactivator 12 to trigger a deactivation cycle.

Figure 5:
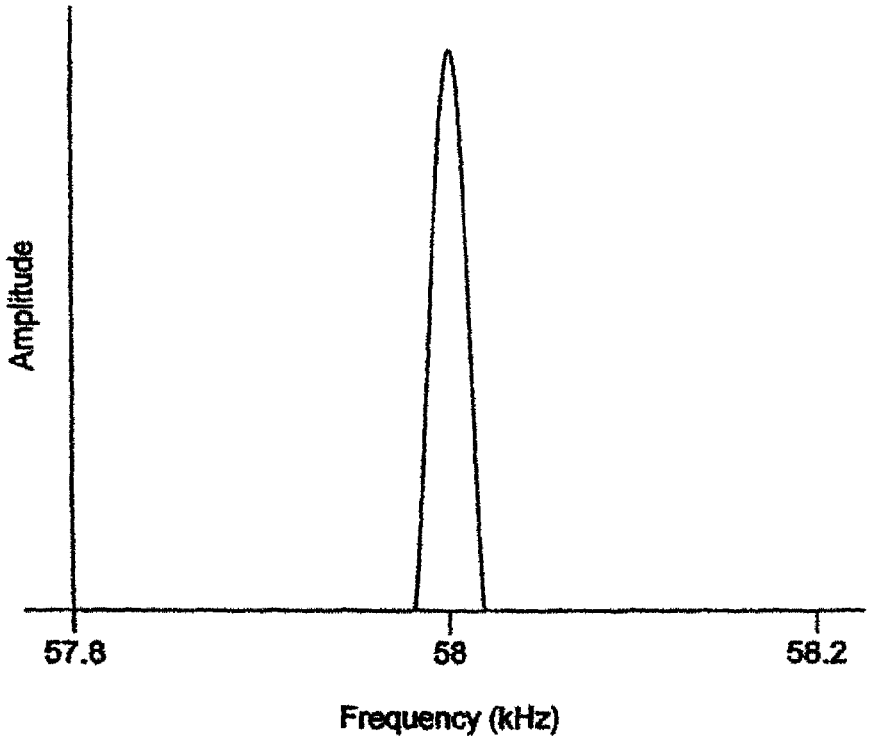
FIG. 5 is a graph illustrating a frequency response distribution of an exemplary sampling of EAS tag responses.
Figure 6:
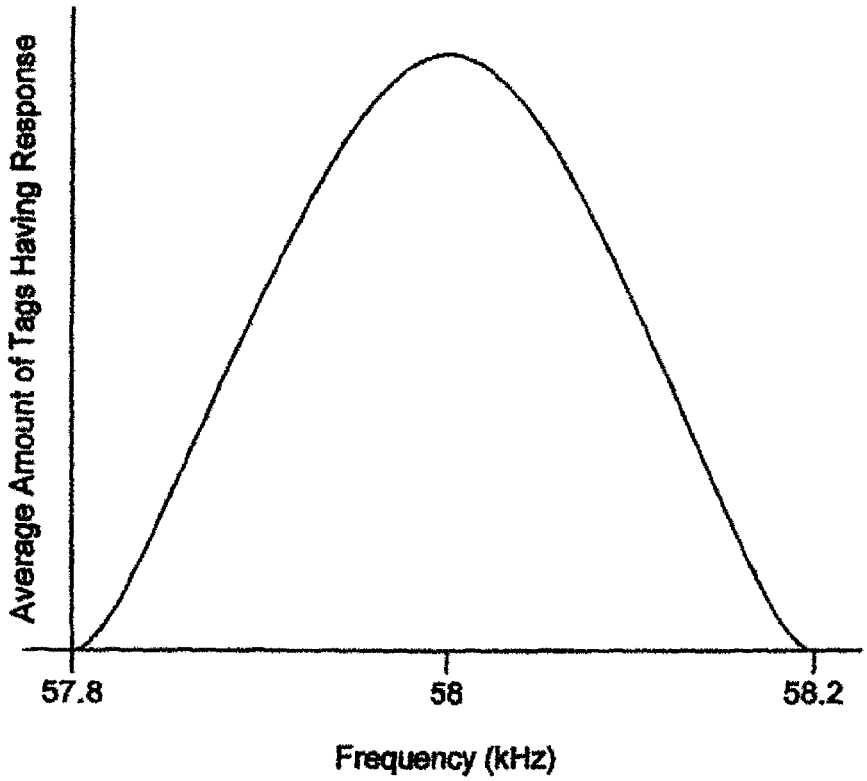
FIG. 6 is a graph illustrating an exemplary frequency response of a single EAS tag response.
Figure 7:
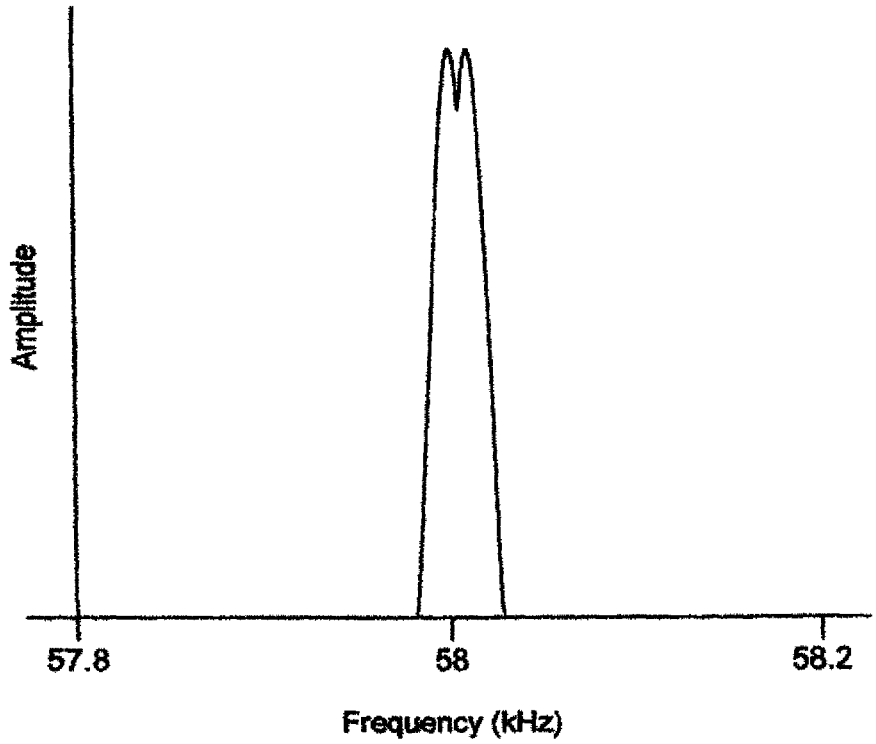
FIG. 7 is a graph illustrating an exemplary frequency response when two EAS tags are simultaneously detected in accordance with the principles of the present invention.

The process begins when the EAS tag detector 44 detects the presence of at least one EAS tag 14 within the interrogation zone (step S100). Generally, to detect an EAS tag 14, the EAS tag deactivator 12 transmits an RF pulse within the interrogation zone which causes the EAS tag 14 resonate at its natural resonant frequency. A frequency response signal for an exemplary EAS tag 14 is shown in FIG. 5. In the embodiment illustrated in FIG. 5, the EAS tags 14 may generate a response signal centered around 58 kHz, with a bell curve distribution pattern of ±200 Hz, as shown in FIG. 6. As the natural response frequency of each tag may inherently be slightly different, if more than one EAS tag 14 is present, the resultant frequency response generated by the combined EAS tags 14 will have multiple peaks, as shown in FIG. 7.

Figure 8:
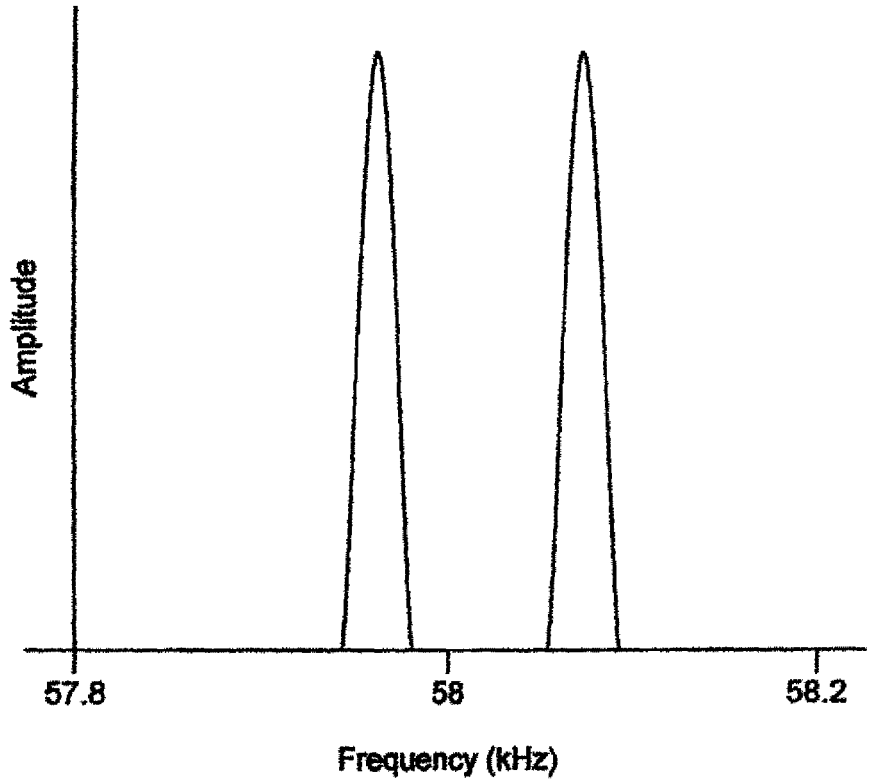
FIG. 8 is a graph illustrating an exemplary frequency response of two EAS tags detected simultaneously and shifted by a DC bias field in accordance with the principles of the present invention.

The EAS tag detector 44 may optionally apply an intermittent DC bias current (step S102) to produce an electromagnetic field within the deactivation zone to more readily detect the different response frequency peaks. The electromagnetic field shifts the response frequencies of the EAS tags 14 dependant upon such factors as the composition of the materials within the EAS tag 14, the strength of the DC current, and the spatial positioning of the EAS tags 14. Each tag 14 reacts slightly differently to the DC-biased field, causing different levels of frequency shift in each of the EAS tags 14 present in the EAS tag deactivator's 12 detection field. The differences in frequency shift are due primarily because the tags 14 are located in different locations and orientations relative to the EAS tag deactivator 12. Thus, in the event that the EAS tags 14 undergoing deactivation happen to have response (peak) frequencies so close in value that the frequency discriminator 38 cannot discern more than one tag 14, the applied DC-bias current changes the electromagnetic field enough that the frequency response peaks shift apart and allows the detection of multiple tags 14, as shown in FIG. 8. By intermittently applying the bias current, the peak response frequencies of different EAS tags 14 are detected even if one response would normally be masked or hidden by the other response.

The frequency discriminator 46 may operate according to known techniques, such as using a Fast Fourier Transform ("FFT") filter or alternative algorithm to detect multiple frequencies. The EAS tag detector 44 then uses the determined frequencies to calculate the separation between the frequencies (step S104). If the separation between the detected frequencies is less than a predetermined value, e.g., 50 Hz (step S106), then the EAS tag detector 44 concludes that only one EAS tag 14 is currently being deactivated and allows the EAS tag 14 to be deactivated as normal. Based on the Q factor of existing EAS labels, the present invention is able to discriminate frequencies with peaks separated by about 50 to 100 Hz. Therefore, the lower limit for detection should be set in this range. However, the separation distance may be decreased for situations where the user wishes to capture video of suspected sweet-hearting events. The separation distance may be increased if the user wishes to disable deactivation to prevent potential false alarms, which may cause an inconvenience to the customer.

However, if the separation between the frequencies exceeds the predetermined value (step S106), then the EAS tag detector 44 may trigger the video recording system 26 to capture video images of the area surrounding the EAS deactivator 12 (step S110) or flag video images already being recorded so that the incident may be further investigated. Additionally and/or alternately, the EAS tag detector 44 may log information relevant to the incident in the database 22 (step S112) or data memory 40 so that the incident may be further investigated. The information may include a time and date of the incident, the name or other identifier of the cashier on duty at the time of the incident, the name or other identifier of a manager on duty at the time of the incident, an identifier for the point of transaction terminal, transaction-specific information, etc. The EAS tag detector 44 may also disable the EAS tag deactivator 12 from further use (step S114) so that it does not operate to deactivate even the newly detected tags, requiring a manager or other authorized personnel to reset the EAS tag deactivator 12 before it can be used again. Additionally, the EAS tag detector 44 may further trigger an audible and/or a visual alarm.

The present invention advantageously provides a method to detect to sweet-hearting and to collect evidence of theft that may be used to build a case for future prosecution. The present invention can be realized in hardware, software, or a combination of hardware and software. Any kind of computing system, or other apparatus adapted for carrying out the methods described herein, is suited to perform the functions described herein.

A typical combination of hardware and software could be a specialized or general purpose computer system having one or more processing elements and a computer program stored on a storage medium that, when loaded and executed, controls the computer system such that it carries out the methods described herein. The present invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A method for determining a presence of multiple electronic article surveillance ("EAS") tags within an interrogation zone, the method comprising:

transmitting an electromagnetic pulse within an EAS interrogation zone to induce a response from at least one EAS tag placed within the interrogation zone;

receiving the response of the at least one EAS tag; and determining a presence of more than one EAS tag by evaluating a frequency response curve corresponding to the response, determining a presence of more than one EAS tag includes determining that the frequency response curve contains more than one peak, and evaluating the frequency response curve corresponding to the response includes:

calculating a frequency peak separation between the more than one peaks; and determining that the frequency peak separation is greater than a predetermined value.

2. The method of claim 1, wherein determining that the frequency response contains more than one peak includes applying a fast Fourier transform filter to the received frequency response.

3. The method of claim 1, further comprising, responsive to determining that the separation is less than a predetermined value, deactivating an EAS tag within the interrogation zone.

4. The method of claim 1, further comprising:

generating an electromagnetic field within the interrogation zone; and applying a DC bias current to the electromagnetic field.

5. The method of claim 1, further responsive to determining the presence of more than one EAS tag, further includes triggering a video recording system to capture a video image of the interrogation zone.

6. The method of claim 1, further responsive to determining the presence of more than one EAS tag, instructing a video recording system to flag a captured video image of the interrogation zone corresponding to a time when the presence of more than one EAS tag was detected.

7. The method of claim 1, further comprising responsive to determining the presence of more than one EAS tag, inhibiting EAS tag deactivation.

8. An electronic article surveillance ("EAS") tag deactivator for deactivating at least one EAS tag, the EAS tag deactivator comprising:

a transceiver operable to:

transmit an electromagnetic pulse within an EAS interrogation zone to induce a response from the at least one EAS tag placed within the interrogation zone; and receive the response of the at least one EAS tag; and a controller communicatively coupled to the transceiver, the controller operable to:

determine a presence of more than one EAS tag by evaluating a frequency response curve corresponding to the response, determining a presence of more than one EAS tag includes determining that the frequency response curve contains more than one peak;

calculate a frequency peak separation between the more than one peak; and determine that the frequency peak separation is greater than a predetermined value.

9. The EAS tag deactivator of claim 8, wherein the controller is further operable to apply a fast Fourier transform filter to the received response, wherein results of the Fourier transform filter application are used to determine whether the frequency response curve contains more than one peak.

10. The EAS tag deactivator of claim 8, wherein responsive to determining that the separation is not greater than a predetermined value, the controller is further operable to deactivate an EAS tag within the interrogation zone.

11. The EAS tag deactivator of claim 8, wherein responsive to determining the presence of more than one EAS tag, the controller is further operable to inhibit EAS tag deactivation.

12. The EAS tag deactivator of claim 8, further comprising:

an electromagnetic field generator operable to generate an electromagnetic field within the interrogation zone, the electromagnetic field having a DC bias.

13. The EAS tag deactivator of claim 8, further comprising:

a communication interface communicatively coupled to the controller, the communication interface operable to, further responsive to determining the presence of more than one EAS tag, trigger a video recording system to capture a video image of an area surrounding the EAS tag deactivator.

14. A security system for preventing theft of merchandise, the security system comprising:

a plurality of electronic article surveillance ("EAS") tags; and an EAS tag deactivator operable to:

transmit an electromagnetic pulse within an EAS interrogation zone to induce a response from at least one EAS tag placed within the interrogation zone;

receive the response of the at least one EAS tag;

determine that the response contains more than one peak in a frequency response curve corresponding to the response; and evaluate the frequency response curve of the response to determine a presence of more than one EAS tag, evaluating the frequency response curve of the response includes:

calculating a frequency peak separation between the more than one peaks: and determining that the frequency peak separation is greater than a predetermined value.

15. The security system of claim 14, further comprising:

a database communicatively coupled to the EAS tag deactivator, the database operable to store at least one incident report including information relating to determining that the frequency response contains more than one peak.

16. The security system of claim 14, further comprising:

a video recording system communicatively coupled to the EAS tag deactivator, the video recording system operable to:

capture a video image of an area surrounding the EAS tag deactivator corresponding to a time when the EAS tag deactivator was inhibited from operating; and flag the captured image for future inspection.

* * * * *